US008926008B1

(12) United States Patent
Al-Hasan

(10) Patent No.: US 8,926,008 B1
(45) Date of Patent: Jan. 6, 2015

(54) PORTABLE FOLDING CHAIR

(71) Applicant: Khaled Jafar Al-Hasan, Al-Zahra (KW)

(72) Inventor: Khaled Jafar Al-Hasan, Al-Zahra (KW)

( * ) Notice: Subject to any disclaimer, the term of this patent is extended or adjusted under 35 U.S.C. 154(b) by 0 days.

(21) Appl. No.: 14/469,519

(22) Filed: Aug. 26, 2014

(51) Int. Cl.

| | |
|---|---|
| ***A47C 7/66*** | (2006.01) |
| ***A47C 7/22*** | (2006.01) |
| ***A47C 4/00*** | (2006.01) |
| ***A47C 7/72*** | (2006.01) |
| ***A47C 7/50*** | (2006.01) |
| ***A47C 1/14*** | (2006.01) |
| ***A47C 1/024*** | (2006.01) |
| ***A47C 7/62*** | (2006.01) |

(52) U.S. Cl.
CPC ..... *A47C 1/146* (2013.01); *A47C 1/024* (2013.01); *A47C 7/62* (2013.01); *A47C 7/72* (2013.01); *A47C 7/66* (2013.01); *A47C 4/00* (2013.01); *A47C 7/22* (2013.01)
USPC ..... 297/17; 297/58; 297/69

(58) Field of Classification Search
USPC ..... 297/17, 39, 50, 58, 16.1, 80, 69
See application file for complete search history.

(56) References Cited

U.S. PATENT DOCUMENTS

| | | | | |
|---|---|---|---|---|
| 811,475 | A * | 1/1906 | Bradley | 190/8 |
| 6,402,231 | B1 * | 6/2002 | Pedemonte | 297/17 |
| 7,309,106 | B2 | 12/2007 | Stallman | |
| 7,438,355 | B2 * | 10/2008 | Pedemonte | 297/17 |
| 7,628,450 | B2 * | 12/2009 | Castagnola et al. | 297/38 |
| 7,753,441 | B1 | 7/2010 | Gray, Jr. | |
| 7,967,302 | B2 | 6/2011 | Coetzee | |
| 7,997,291 | B2 | 8/2011 | Gressette, III et al. | |
| 8,297,642 | B2 | 10/2012 | Tyson, III | |
| 8,573,454 | B2 * | 11/2013 | Talavera Tolentino | 224/155 |
| 2004/0251717 | A1 * | 12/2004 | Tamura | 297/17 |
| 2008/0036256 | A1 * | 2/2008 | Gold et al. | 297/255 |
| 2008/0290698 | A1 * | 11/2008 | Lewis | 297/16.1 |
| 2009/0224496 | A1 * | 9/2009 | Watts | 280/47.38 |
| 2009/0254011 | A1 * | 10/2009 | Chi | 601/134 |
| 2011/0156448 | A1 * | 6/2011 | Fletcher | 297/16.1 |
| 2011/0193372 | A1 * | 8/2011 | Pizzuto | 297/16.1 |
| 2012/0205951 | A1 | 8/2012 | Strolka-Echols | |
| 2014/0284970 | A1 * | 9/2014 | Radclyffe | 297/16.1 |

FOREIGN PATENT DOCUMENTS

| | | |
|---|---|---|
| CN | 202891217 U | 4/2013 |

* cited by examiner

*Primary Examiner* — David R Dunn
*Assistant Examiner* — Timothy J Brindley
(74) *Attorney, Agent, or Firm* — Richard C. Litman

(57) ABSTRACT

The portable folding chair is a compact, folding multi-functional chair providing storage for, and interconnection with, a wide variety of auxiliary gear. The portable folding chair includes a seat, a backrest pivotally joined to a rear end of the seat, and a pair of sidewalls respectively secured to a pair of side edges of the seat. An upper edge of each sidewall has a substantially arcuate contour. A substantially U-shaped frame having opposed open and closed ends is provided, with the closed end being adapted for supporting a user's feet. The open end is pivotally secured to respective front edges of the sidewalls. A rear surface of the backrest and the substantially U-shaped frame are each substantially arcuate such that the rear surface of the backrest and the substantially U-shaped frame are positioned adjacent to, and in substantial alignment with, the upper edges of the pair of sidewalls when folded.

20 Claims, 10 Drawing Sheets

PORTABLE FOLDING CHAIR

BACKGROUND OF THE INVENTION

1. Field of the Invention

The present invention relates to collapsible, transportable furniture, and particularly to a portable folding chair provided with storage and attachments for auxiliary gear.

2. Description of the Related Art

Portable folding chairs, such as, for example, poolside chaise lounges, are well known. Such chairs are typically relatively simple structures, including two or more panels, a pair of arms, and a folding frame structure. Since such folding chairs are often carried by hand, they are designed to be as simple and lightweight as possible. Unfortunately, because of this design requirement, any additional equipment or gear must be carried separately, either by hand or in separate luggage. It would be desirable to provide a multi-functional folding chair, providing the convenience and ease of transport as a conventional folding chair with the ability to store, transport and attach additional gear. Thus, a portable folding chair addressing the aforementioned problems is desired.

SUMMARY OF THE INVENTION

Embodiments of a portable folding chair provide a compact, folding multi-functional chair providing storage for, and interconnection with, a wide variety of auxiliary gear. The portable folding chair includes a seat, a backrest pivotally joined at a lower end thereof to a rear end of the seat, and a pair of sidewalls respectively secured to a pair of side edges of the seat. Desirably, an upper edge of each sidewall has a substantially arcuate contour. A substantially U-shaped frame having opposed open and closed ends is further provided, with the closed end thereof being adapted for supporting a user's feet. The open end thereof is pivotally secured to respective front edges of the pair of sidewalls. A rear surface of the backrest and a side contour of the substantially U-shaped frame are each desirably substantially arcuate such that the rear surface of the backrest is positioned adjacent to, and in substantial alignment with, the upper edges of the pair of sidewalls when the backrest is in a folded configuration, and a pair of side members of the substantially U-shaped frame are respectively positioned adjacent to, and in substantial alignment with, the upper edges of the pair of sidewalls.

Also, desirably, at least one sidewall defines at least one storage compartment. At least one cover is provided for releasably covering a corresponding at least one storage compartment defined in a corresponding sidewall. At least one solar panel can be mounted on an upper surface of at least one cover for electrical communication with at least one electrical outlet mounted on at least one of the sidewalls.

These and other features of the present invention will become readily apparent upon further review of the following specification and drawings.

BRIEF DESCRIPTION OF THE DRAWINGS

Unless otherwise indicated, similar reference characters denote corresponding features consistently throughout the attached drawings.

DETAILED DESCRIPTION OF THE PREFERRED EMBODIMENTS

Embodiments of a portable folding chair, such as a portable folding chair 100, are compact, folding multi-functional chairs providing storage for, and interconnection with, a wide variety of auxiliary gear. As best shown in FIGS. 1, 2, 5 and 9, the portable folding chair 100 includes a seat 21, a backrest 22 pivotally joined at a lower end 22*a* thereof to a rear end 21*b* of the seat 21, and a pair of sidewalls 20 respectively secured to a pair of side edges 21*a* of the seat 21. It should be understood that the pivotal connection (shown generally as 50 in FIGS. 5 and 9) between seat 21 and backrest 22 can be any suitable type of pivoting connection or fixture, such as a hinge or the like.

It should also be understood that the structural elements of the portable folding chair 100 can be made from any of various suitable and desired materials, such as, for example, a lightweight, weather resistant, rust resistant, resilient fiberglass material or the like, as can depend on the use or application, and should not be construed in a limiting sense. Further, it should be understood that the overall contouring and relative dimensions of the portable folding chair 100 can be varied, dependent upon the particular needs and desires of the user, or the particular use or application, for example.

Figure 1:
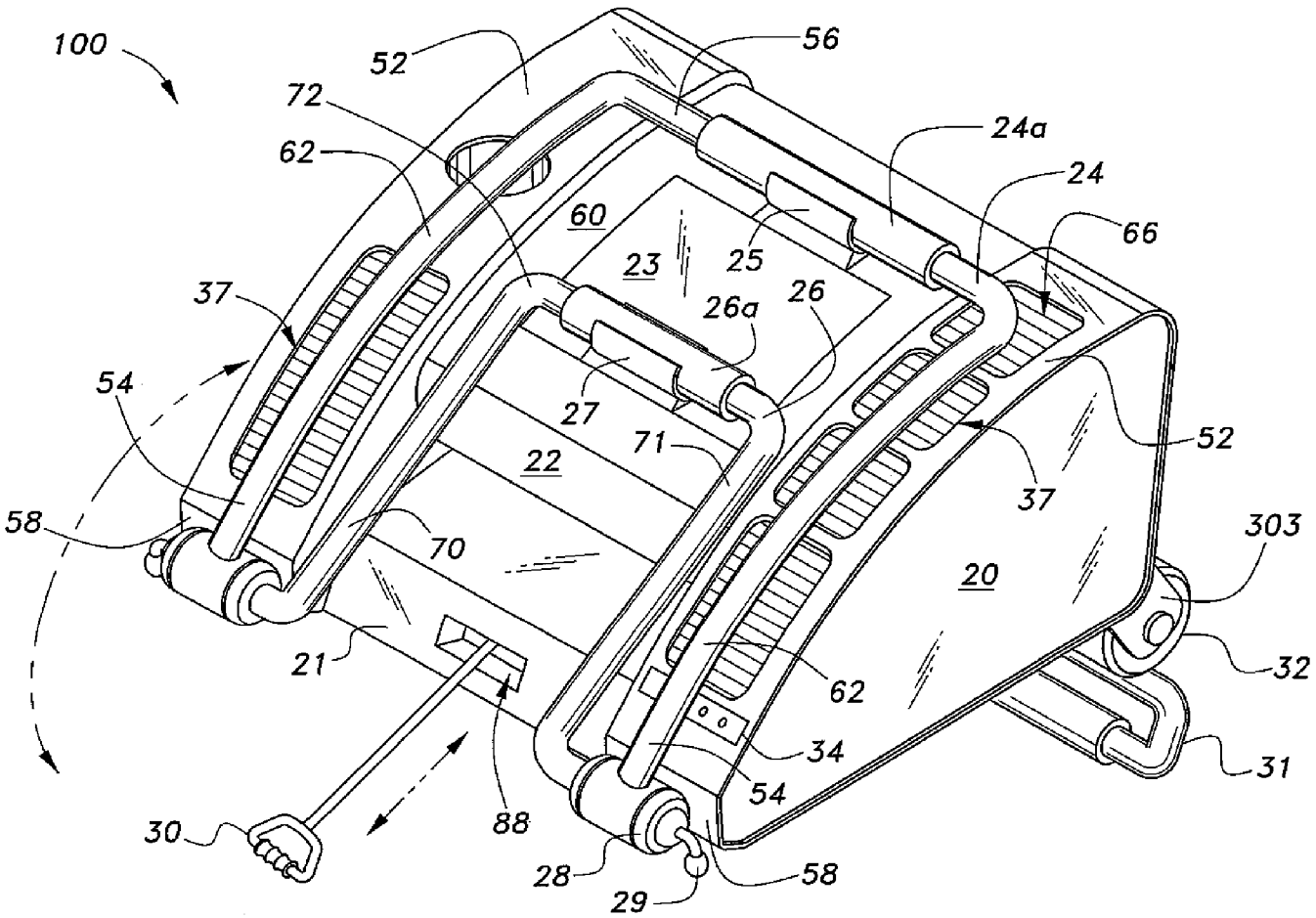
FIG. 1 is a perspective front view of an embodiment of a portable folding chair according to the present invention in a folded configuration.
Figure 2:
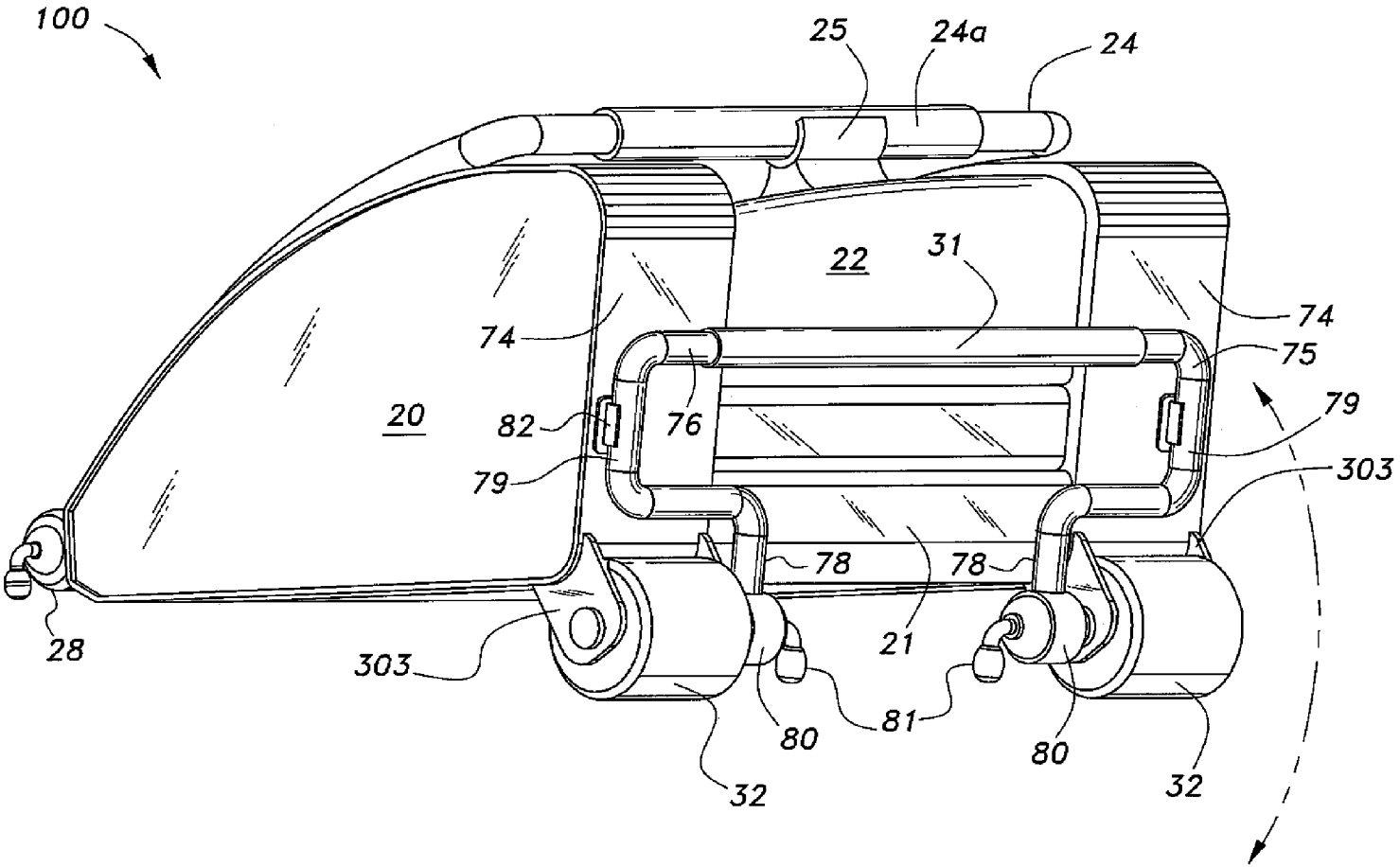
FIG. 2 is a rear perspective view of the portable folding chair of FIG. 1 according to the present invention.
Figure 4:
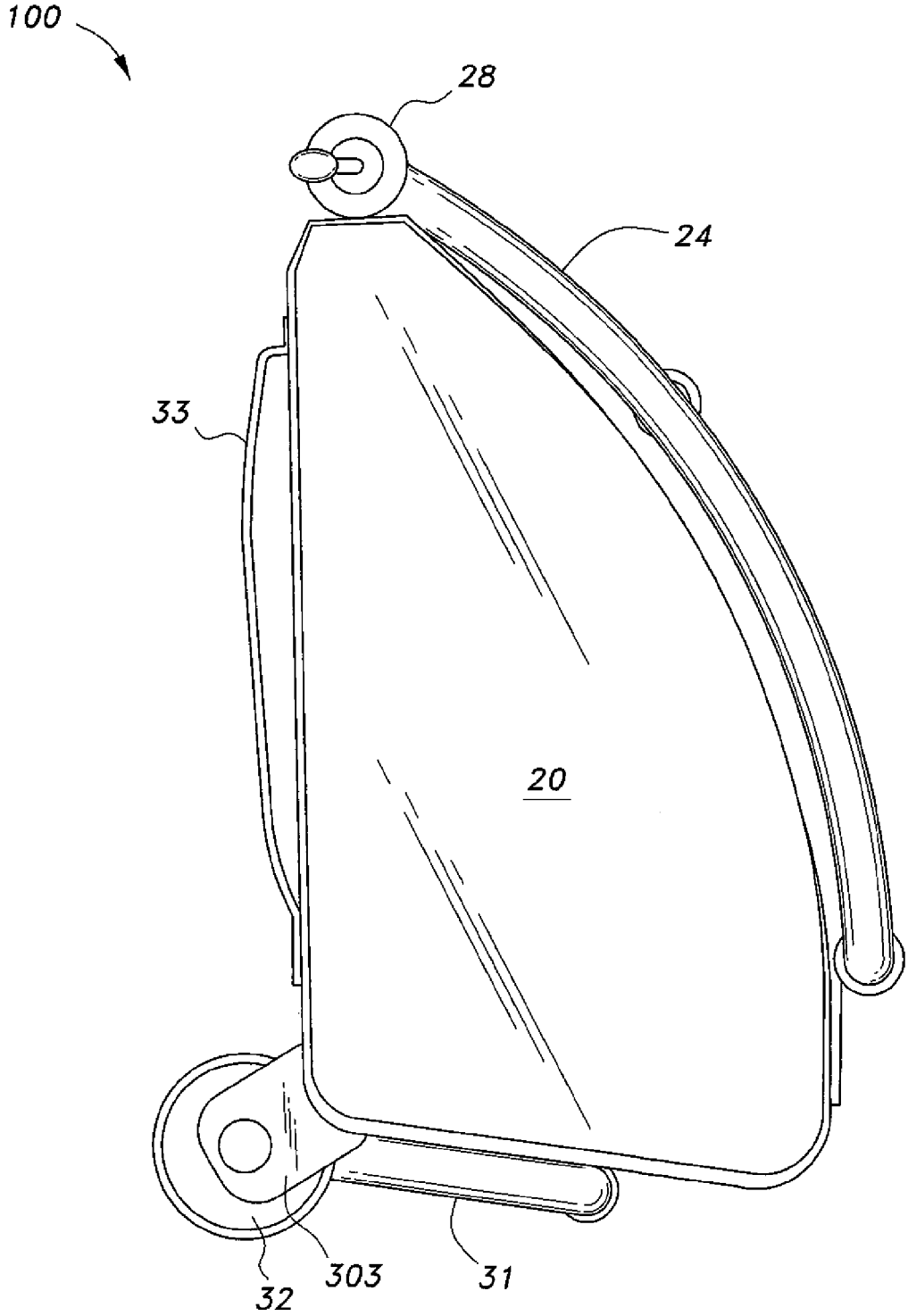
FIG. 4 is a side view of the portable folding chair of FIG. 1 according to the present invention.
Figure 5:
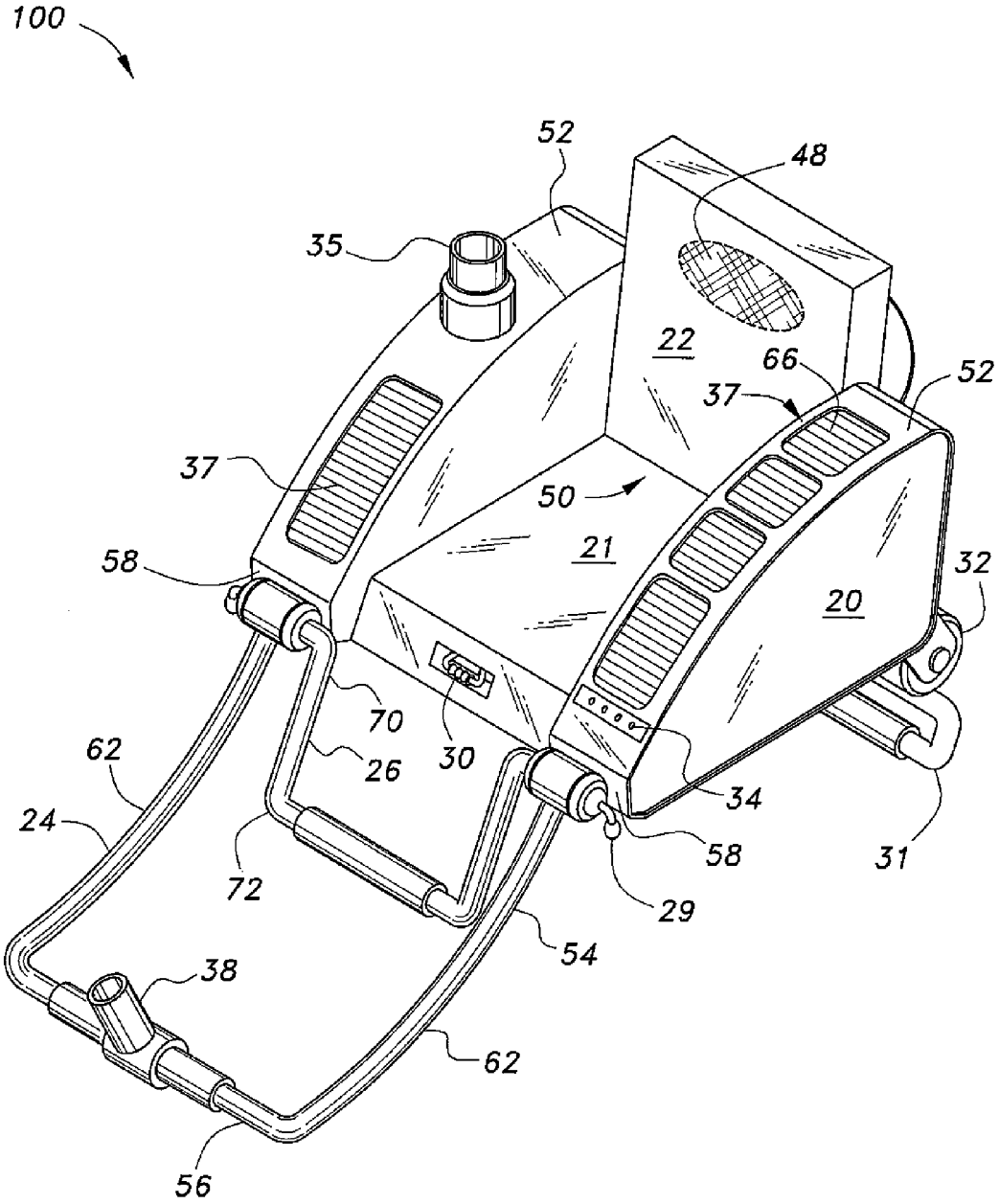
FIG. 5 is a front perspective view of the portable folding chair of FIG. 1 in a deployed configuration according to the present invention.
Figure 10:
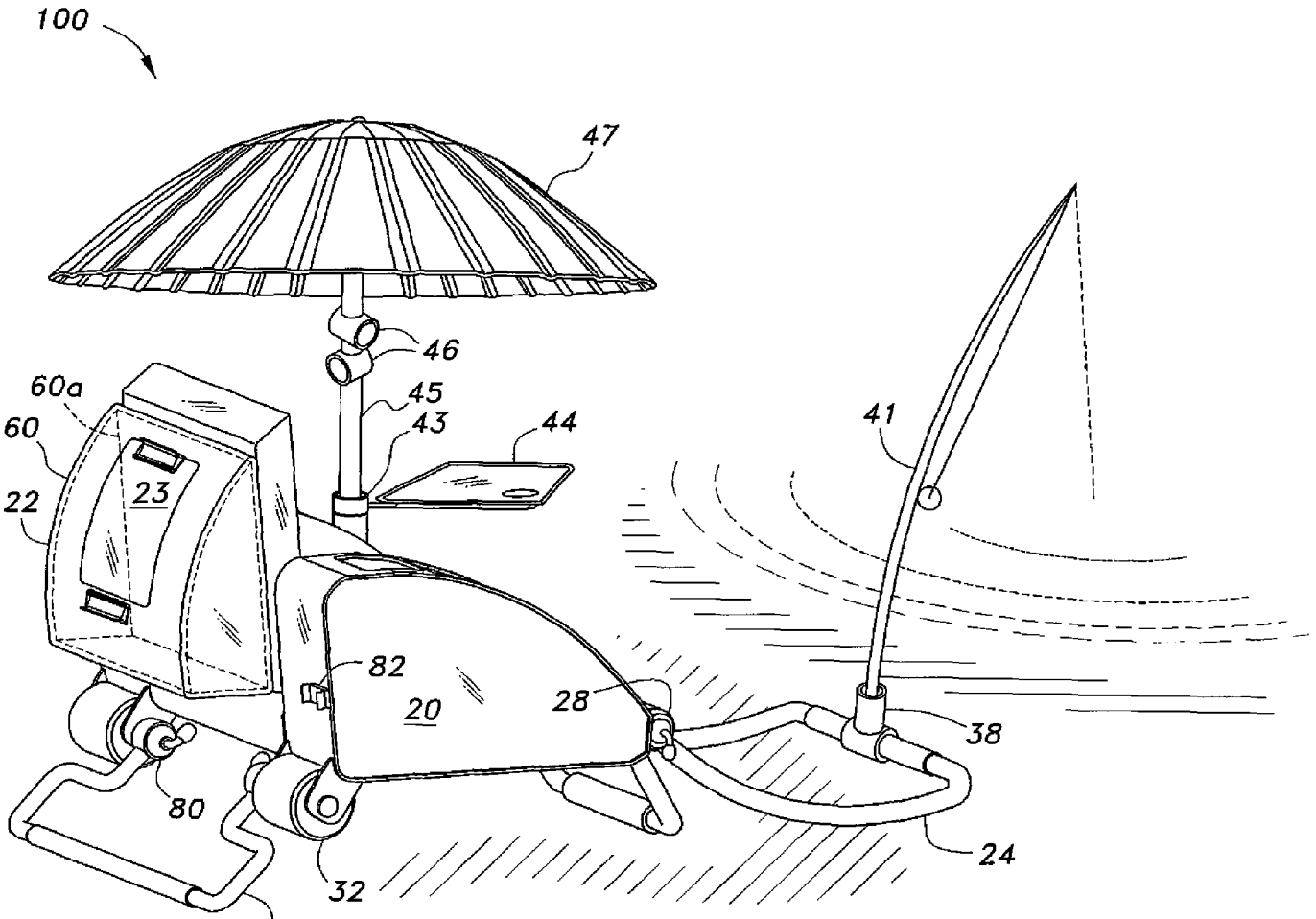
FIG. 10 is a rear, environmental perspective view of the portable folding chair of FIG. 1 deployed with both the auxiliary umbrella and table attachment of FIG. 7 and the auxiliary fishing rod attachment of FIG. 8 according to the present invention.

Desirably, an upper edge 52 of each sidewall 20 has a substantially arcuate contour, such as illustrated in FIGS. 1, 2 and 5, for example. A substantially U-shaped frame 24 having opposed open and closed ends 54, 56, respectively, is further provided, with the closed end 56 being adapted for supporting feet of a user of the portable folding chair 100. The open end 54 is pivotally secured to respective front edges 58 of the pair of sidewalls 20. As shown in FIGS. 1, 4 and 10, a rear surface 60 of the backrest 22 and a side contour of the substantially U-shaped frame 24 are each desirably substantially arcuate such that the rear surface 60 of the backrest 22 is positioned adjacent to, and in substantial alignment with, the upper edges 52 of the pair of sidewalls 20 when the backrest 22 is in a folded configuration, and a pair of side members 62 of the substantially U-shaped frame 24, when in a folded configuration, are respectively positioned adjacent to, and in substantial alignment with, the upper edges 52 of the pair of sidewalls 20, as shown in the configuration of FIG. 1.

It should be understood that the substantially U-shaped frame 24 can be constructed of any of various suitable materials, such as, for example, conventional tubular materials commonly used in folding chairs and the like, as can depend on the use or application, and should not be construed in a limiting sense. Also, the portable folding chair 100 typically can be designed to store and carrying various types of items, such as coolers, umbrellas, a relatively small auxiliary chair or seat, towels, fishing gear, various personal items etc., for example; and can be designed to support various weight capacities, such as approximately a 250 pound (lb.) seating capacity and approximately a 50 lb. storage capacity, for example, as can depend on the use or application, and should not be construed in a limiting sense.

Figure 6:
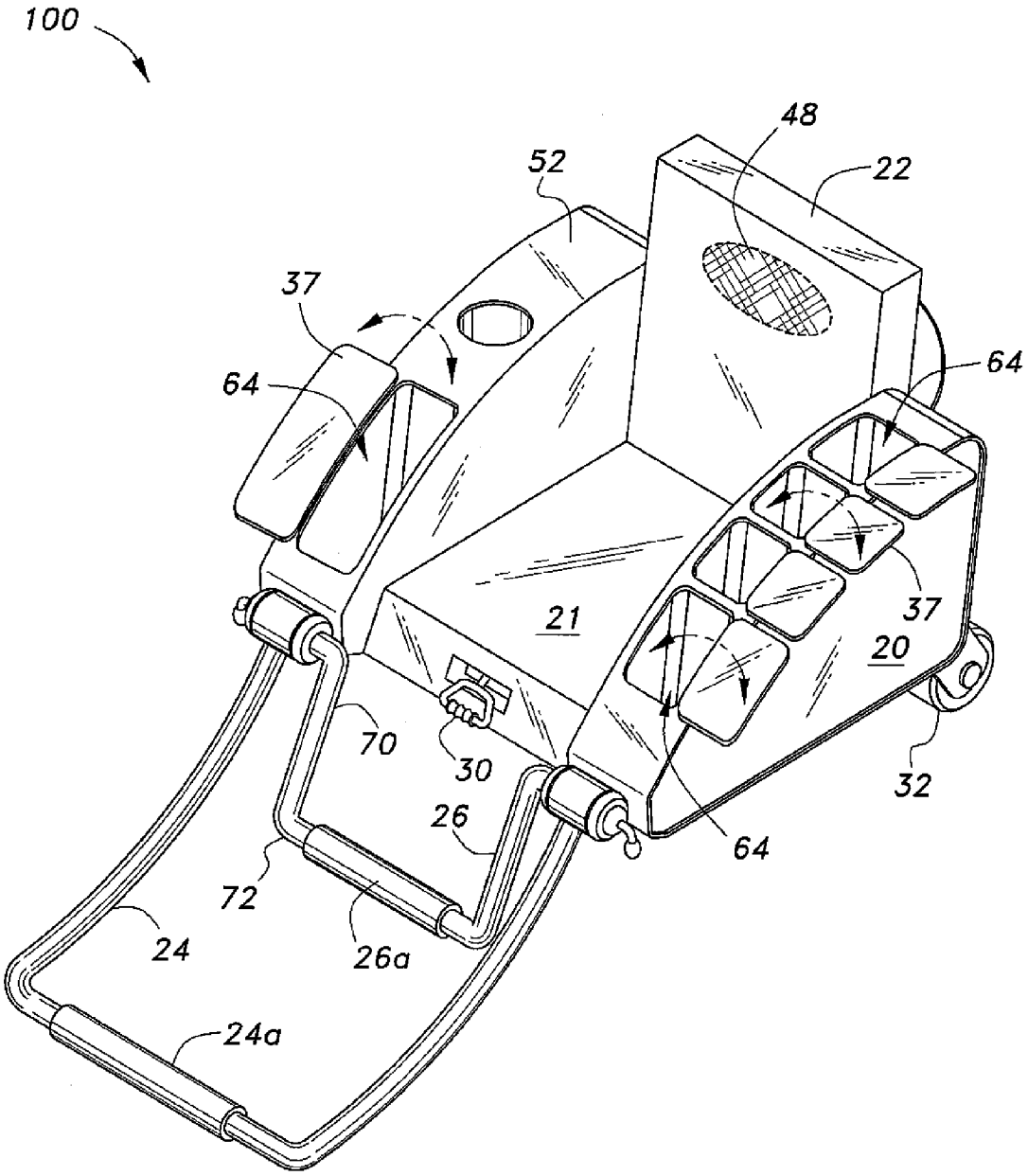
FIG. 6 is a front perspective view of the portable folding chair of FIG. 1 in a deployed configuration according to the present invention.

Referring to FIGS. 1, 5 and 6, at least one sidewall 20, and desirably each sidewall 20, defines at least one storage compartment 64. At least one cover 37 is provided for releasably covering a corresponding at least one storage compartment 64 defined in a corresponding sidewall 20. At least one solar panel 66 can be mounted on an upper surface of at least one cover 37 for electrical communication, such as through suitable, known power conversion/storage devices and connections, with at least one electrical outlet 34 mounted on at least one of the sidewalls 20. The at least one electrical outlet 34 can be provided for providing power to a mobile device charger or other electric device charger or the like, or for lights that can attach to an umbrella 47, as will be described in greater detail below.

Additionally, as shown in FIG. 10, at least one rear storage compartment 60*a* can be defined in the backrest 22 covered by a door 23 as can be defined in the rear surface 60 of the backrest 22. As shown in FIGS. 1, 5, 6 and 10, the storage compartments 60*a* and 64 can be provided in various differing numbers and sizes, as can depend upon the particular needs and desires of the user, as also can depend on the use or application, for example. As will be described in greater detail below, the relatively larger storage compartment 64 shown in the example of FIG. 6 can be used for storage of an umbrella, table and/or fishing gear, for example.

Further, in addition to the substantially U-shaped frame 24 forming a foot rest, a front support member 26 can be additionally provided. The front support member 26 includes a substantially U-shaped front supporting frame 71 having opposed open and closed ends 70, 72, respectively, with the closed end 72 being adapted for contacting a support surface, such as a ground surface, and the open end 70 being pivotally secured to respective ones of the front edges 58 of the pair of sidewalls 20. Desirably, a first pair of pivotal friction locks 28 are respectively mounted on the front edges 58 of the pair of sidewalls 20, such that both the open end 54 of the substantially U-shaped frame 24 and the open end 70 of the substantially U-shaped front supporting frame 71 are pivotally secured to the front edges 58 of the pair of sidewalls 20 by the first pair of pivotal friction locks 28.

It should be understood that any suitable type of pivots and/or pivoting locks can be utilized, and that pivotal friction locks 28, actuated by respective keys 29, are shown for exemplary purposes only, and should not be construed in a limiting sense. First and second retaining members 25, 27, respectively, are mounted on the rear surface 60 of the backrest 22 for respectively receiving and releasably securing the closed ends 56, 72, respectively, of the substantially U-shaped frame 24 and the substantially U-shaped front supporting frame 71. As shown, cuffs 24*a*, 26*a* can be additionally respectively provided on the substantially U-shaped frame 24 and on the substantially U-shaped front supporting frame 71 for additional frictional engagement with retaining members 25, 27, and further for engagement with the support surface, such as a ground surface. Cuff 24*a* can also be used as a padded foot rest for the feet of a user of the portable folding chair 100.

As best shown in FIGS. 1 and 2, a pair of wheels 32 are rotatably mounted to respective rear edges 74 of the pair of sidewalls 20. Desirably, each of the pair of wheels 32 are rotatably held within a respective pair of wheel brackets 303 secured to the rear edges 74 of the pair of sidewalls 20. It should be understood that the wheels 32 shown in FIG. 2 are shown for exemplary purposes only, and that any suitable type of wheels and corresponding brackets or retainers can be utilized, as can depend on the use or application, and should not be construed in a limiting sense. As shown in FIGS. 1 and 2, a rear support member 31 is further provided. The rear support member 31 includes a substantially U-shaped rear supporting frame 75 having opposed closed and open ends 76, 78, respectively. The closed end 76 is adapted for contacting a support surface, such as a ground surface, and the open end 78 is pivotally secured to respective ones of the pair of wheel brackets 303.

A second pair of pivotal friction locks 80, actuated by respective keys 81, similar to the first pair of pivotal friction locks 28 and the keys 29, are respectively mounted on the pair of wheel brackets 303, such that the open end 78 of the substantially U-shaped rear supporting frame 75 of the rear support member 31 is pivotally secured to the pair of wheel brackets 303 by the second pair of pivotal friction locks 80. As shown, retaining members 82, similar to retaining members 25, 27, can be mounted on the rear surfaces 74 of the sidewalls 20 for releasably securing legs 79 of the substantially U-shaped rear supporting frame 75. A retractable pulling arm 30 can be attached to the portable folding chair 100 through a recess 88 in the chair seat 21, enabling the user to pull the portable folding chair 100 as it rolls on the wheels 32.

Figure 3:
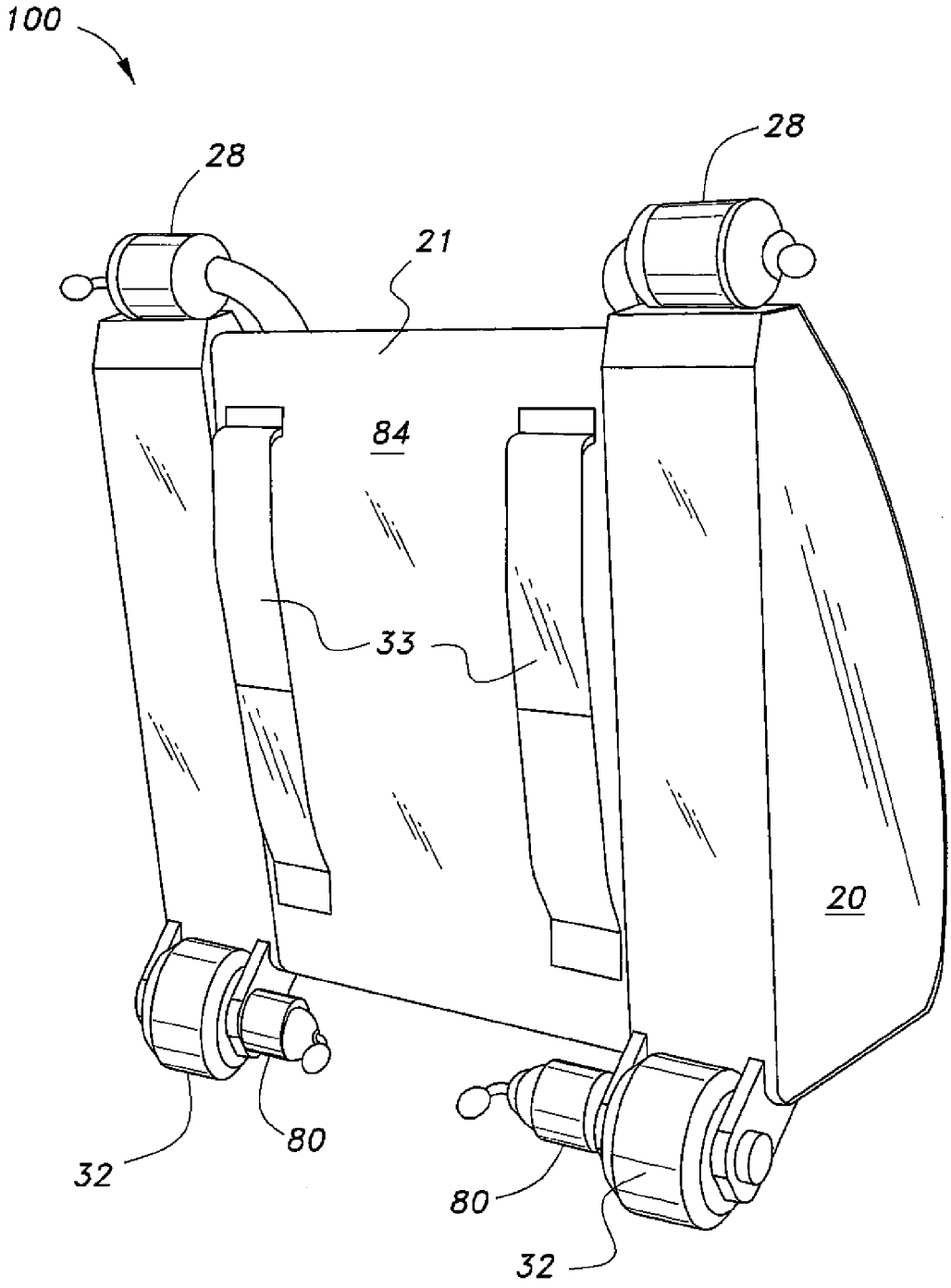
FIG. 3 is a lower perspective view of the portable folding chair of FIG. 1 according to the present invention.

Also, as shown in FIG. 3, at least one carrying strap 33 can be secured to a lower surface 84 of the seat 21. In FIG. 3, two such straps 33 are shown so that the folding chair 100 can be carried like a backpack when in the folded configuration. As noted above, the relative overall dimensions of the folding chair 100 can be varied, and desirably the wheels 32 can be relatively widely spaced apart for optimal stability on uneven surfaces, such as sandy beaches and the like, for example. Further, it should be understood that the wheels can be varied or manufactured dependent upon particular applications, such as, for example, the usage of rugged, relatively wide or large wheels, such as, for example, balloon type wheels, for an exemplary beach environment.

Figure 7:
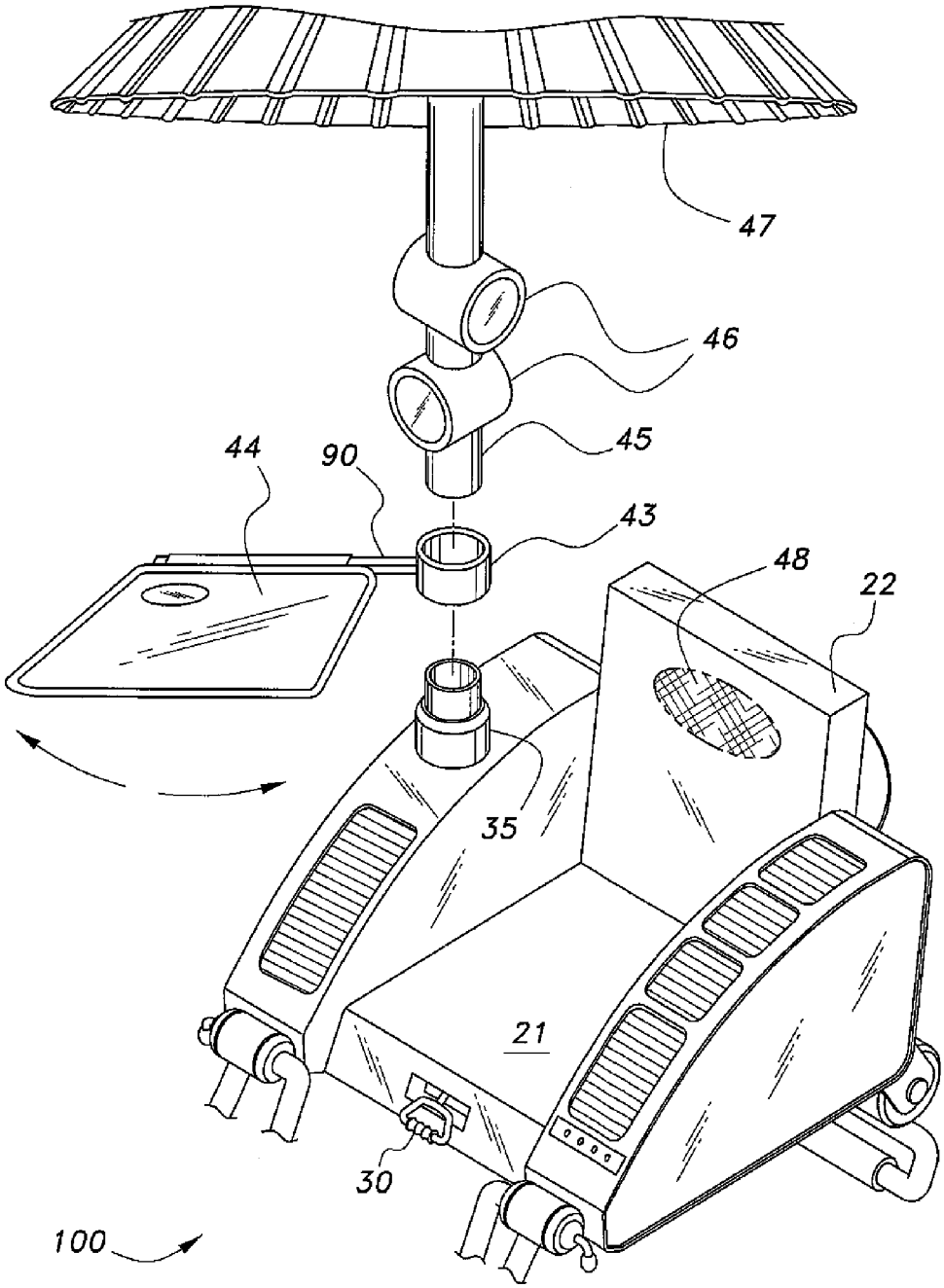
FIG. 7 is a partial perspective view of the portable folding chair of FIG. 1 shown with an auxiliary umbrella and table attachment according to the present invention

As best shown in FIGS. 5 and 7, an umbrella receptacle, such as an umbrella locking collar and sleeve arrangement 35, extends from the upper surface 52 of one of sidewalls 20 to provide a releasable friction fitting for an umbrella connecting rod 45 of the umbrella 47, and further provide a pivotal fitting for a relatively small table 44. As shown in FIG. 7, the table 44 includes an elongate support rod 90 terminating in an attachment ring 43 that fits over the collar and sleeve arrangement 35. The connecting rod 45 of the umbrella 47 is broken into parts which extend into adjustable adapters 46, which are desirably in the form of friction locking mechanisms allowing for rotation and locking of the umbrella 47 in any of various directions, along with tilting to any of various angles desired by the user, for example, A headrest 48 is desirably further disposed in the backrest 22 to assist in increasing ergonomic comfort of a user of the portable folding chair 100.

Figure 8:
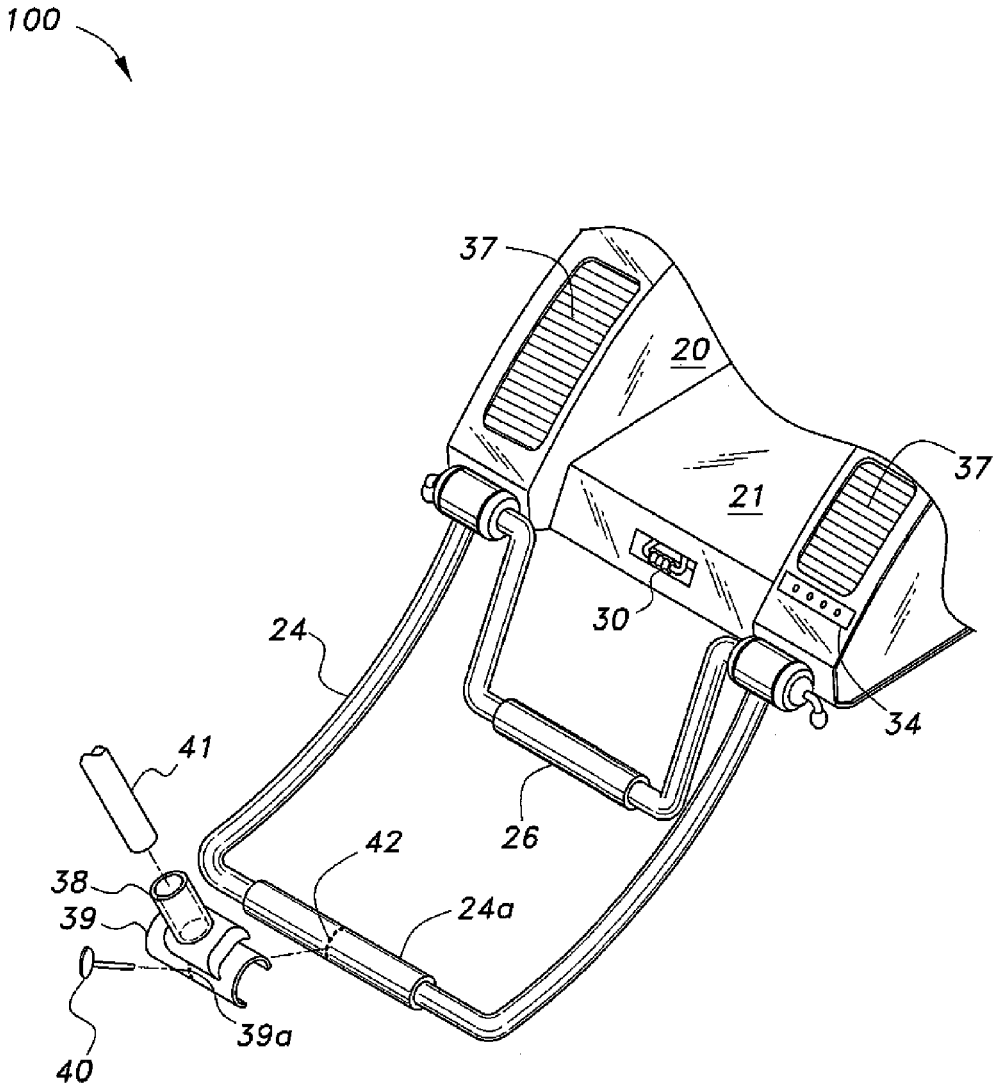
FIG. 8 is a partial perspective view of the portable folding chair of FIG. 1 including an auxiliary fishing rod attachment according to the present invention.
Figure 9:
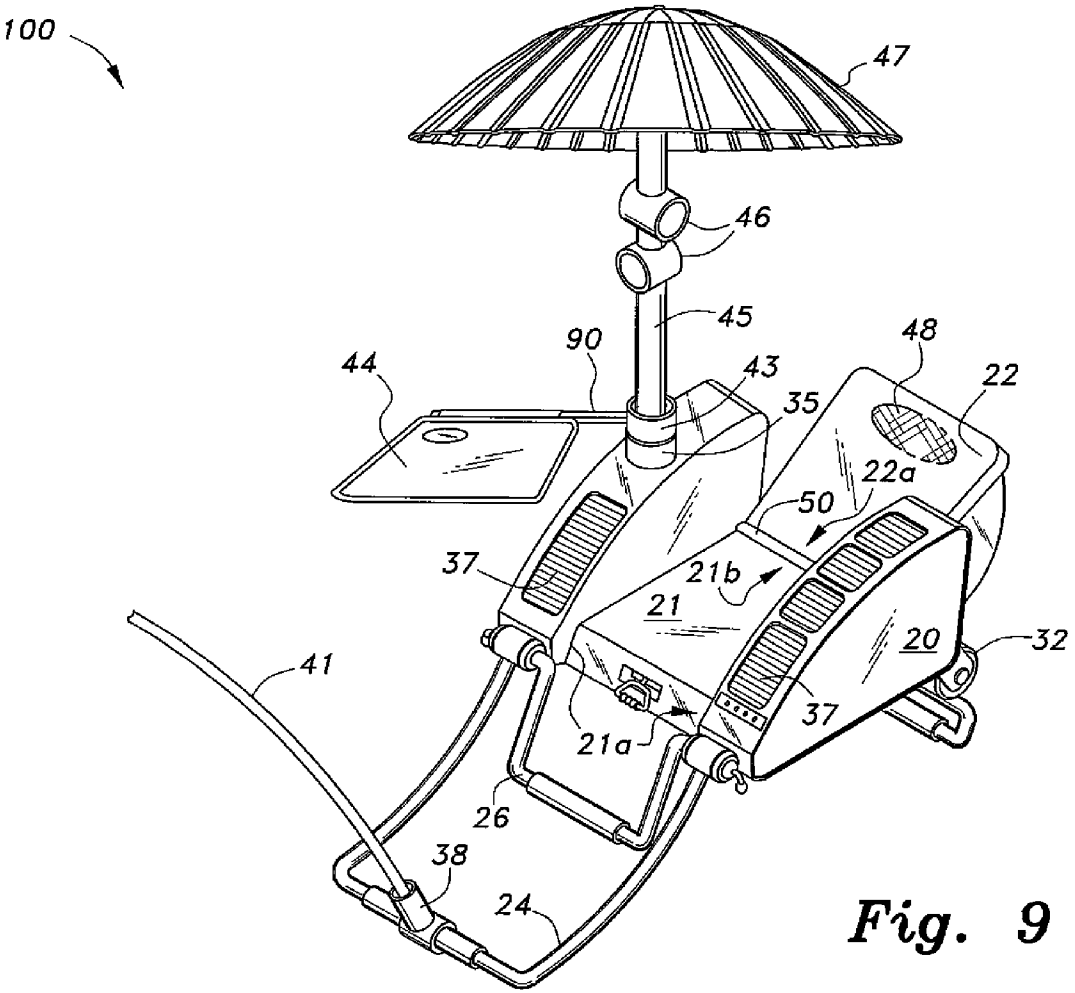
FIG. 9 is a front perspective view of the portable folding chair of FIG. 1 deployed with both the auxiliary umbrella and table attachment of FIG. 7 and the auxiliary fishing rod attachment of FIG. 8 according to the present invention.

As noted above, one of the storage compartments 64 can be sized so as to store the umbrella 47 and the table 44. Further, as best shown in FIG. 8, a hollow cylindrical fishing rod holder 38 can be provided to extend from a coupler 39, which can be coupled via bores 39*a* which align with corresponding attachment bores 42 disposed in the cuff 24*a* on the substantially U-shaped frame 24, as can also form a foot rest, as described, allowing for angular adjustment of a fishing pole 41 inserted into the holder 38 and affixed with a coupler key 40 as the coupler key 40 is inserted through the aligned bores. This arrangement can also be used for attachment of the umbrella connecting rod 45. FIGS. 9 and 10 illustrate the portable folding chair 100 deployed with both the auxiliary umbrella 47 and table 44 attachments and the auxiliary fishing rod 41 attachment, for example.

It is to be understood that the present invention is not limited to the embodiments described above, but encompasses any and all embodiments within the scope of the following claims.

I claim:

1. A portable folding chair, comprising:

a seat;

a backrest pivotally joined at a lower end thereof to a rear end of said seat;

a pair of sidewalls respectively secured to a pair of side edges of said seat, an upper edge of each said sidewall having a substantially arcuate contour; and a substantially U-shaped frame having opposed open and closed ends, the closed end thereof being adapted for supporting a user's feet, and the open end thereof being pivotally secured to respective front edges of said pair of sidewalls, wherein a rear surface of said backrest and a side contour of said substantially U-shaped frame each being substantially arcuate such that the rear surface of said backrest is positioned adjacent to, and in substantial alignment with, the upper edges of said pair of sidewalls when said backrest is in a folded configuration, and a pair of side members of said substantially U-shaped frame are respectively positioned adjacent to, and in substantial alignment with, the upper edges of said pair of sidewalls when said substantially U-shaped frame is in a folded configuration.

2. The portable folding chair as recited in claim 1, wherein each said sidewall defines at least one storage compartment.

3. The portable folding chair as recited in claim 1, further comprising:

a front support member to support the portable folding chair on a support surface.

4. The portable folding chair as recited in claim 3, wherein the front support member comprises a substantially U-shaped front supporting frame having opposed open and closed ends, the closed end thereof being adapted for contacting the support surface, and the open end thereof being pivotally secured to respective ones of the front edges of said pair of sidewalls.

5. The portable folding chair as recited in claim 4, further comprising:

first and second retaining members for respectively receiving and releasably securing the closed ends of the substantially U-shaped frame and the substantially U-shaped front supporting frame, the first and second retaining members each being mounted on the rear surface of the backrest.

6. The portable folding chair as recited in claim 1, further comprising:

a pair of wheels rotatably mounted to respective rear edges of said pair of sidewalls.

7. The portable folding chair as recited in claim 6, further comprising:

a pair of wheel brackets respectively secured to the rear edges of said pair of sidewalls, the pair of wheels being respectively rotatably mounted to the pair of wheel brackets.

8. The portable folding chair as recited in claim 7, further comprising:

a rear support member to support the portable folding chair on a support surface.

9. The portable folding chair as recited in claim 8, wherein the rear support member comprises a substantially U-shaped rear supporting frame having opposed open and closed ends, the closed end thereof being adapted for contacting the support surface, and the open end thereof being pivotally secured to respective ones of the pair of wheel brackets.

10. The portable folding chair as recited in claim 1, further comprising:

at least one carrying strap secured to a lower surface of the seat.

11. The portable folding chair as recited in claim 1, further comprising:

at least one storage compartment defined in at least one of the sidewalls; and at least one cover for releasably covering a corresponding at least one storage compartment defined in a corresponding sidewall.

12. The portable folding chair as recited in claim 11, further comprising:

at least one solar panel mounted on an upper surface of at least one cover.

13. The portable folding chair as recited in claim 12, further comprising:

at least one electrical outlet in electrical communication with the at least one solar panel.

14. The portable folding chair as recited in claim 1, further comprising:

an umbrella receptacle mounted on the upper edge of one of said sidewalls.

15. The portable folding chair as recited in claim 1, further comprising:

a front support member to support the portable folding chair on a support surface, the front support member having a substantially U-shaped front supporting frame having opposed open and closed ends, the closed end thereof being adapted for contacting the support surface, and the open end thereof being pivotally secured to respective ones of the front edges of said pair of sidewalls;

first and second retaining members for respectively receiving and releasably securing the closed ends of the substantially U-shaped frame and the substantially U-shaped front supporting frame, the first and second retaining members each being mounted on the rear surface of the backrest; and a first pair of pivotal friction locks respectively mounted on the front edges of the pair of sidewalls, wherein the open end of the substantially U-shaped frame is pivotally secured to the front edges of the pair of sidewalls by the first pair of pivotal friction locks.

16. The portable folding chair as recited in claim 15, wherein the open end of the substantially U-shaped front supporting frame is pivotally secured to the front edges of the pair of sidewalls by the first pair of pivotal friction locks.

17. The portable folding chair as recited in claim 16, further comprising:

a pair of wheels rotatably mounted to respective rear edges of said pair of sidewalls; and a pair of wheel brackets respectively secured to the rear edges of said pair of sidewalls, the pair of wheels being respectively rotatably mounted to the pair of wheel brackets.

18. The portable folding chair as recited in claim 17, further comprising:

a second pair of pivotal friction locks respectively mounted on the pair of wheel brackets; and a rear support member to support the portable folding chair on the support surface, wherein the rear support member comprises a substantially U-shaped rear supporting frame having opposed open and closed ends, the closed end thereof being adapted for contacting the support surface, and the open end thereof being pivotally secured to respective ones of the pair of wheel brackets, and wherein the open end of the substantially U-shaped rear supporting frame is pivotally secured to the pair of wheel brackets by the second pair of pivotal friction locks.

19. The portable folding chair as recited in claim 1, further comprising:

a fishing rod retainer mounted on the closed end of the substantially U-shaped frame.

20. The portable folding chair as recited in claim 1, wherein a rear storage compartment is defined in the rear surface of said backrest.

* * * * *